US009885356B2

(12) United States Patent
Shinohara

(10) Patent No.: US 9,885,356 B2
(45) Date of Patent: Feb. 6, 2018

(54) VARIABLE DISPLACEMENT PUMP

(71) Applicant: MAHLE FILTER SYSTEMS JAPAN CORPORATION, Tokyo (JP)

(72) Inventor: Toru Shinohara, Yokohama (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 89 days.

(21) Appl. No.: 14/974,308

(22) Filed: Dec. 18, 2015

(65) Prior Publication Data

US 2016/0186751 A1 Jun. 30, 2016

(30) Foreign Application Priority Data

Dec. 25, 2014 (JP) ..... 2014-261445

(51) Int. Cl.

| | |
|---|---|
| ***F04C 14/18*** | (2006.01) |
| ***F04C 14/22*** | (2006.01) |
| ***F04C 2/332*** | (2006.01) |
| ***F04C 2/348*** | (2006.01) |
| ***F04C 2/352*** | (2006.01) |
| ***F04C 15/06*** | (2006.01) |
| ***F04C 18/352*** | (2006.01) |

(Continued)

(52) U.S. Cl.

CPC ..... *F04C 14/22* (2013.01); *F04C 2/332* (2013.01); *F04C 2/348* (2013.01); *F04C 2/352* (2013.01); *F04C 14/226* (2013.01); *F04C 15/06* (2013.01); *F04C 18/352* (2013.01); *F04C 28/22* (2013.01); *F04C 29/12* (2013.01); *F04C 2240/54* (2013.01)

(58) Field of Classification Search

CPC ..... F04C 14/22; F04C 14/226; F04C 2/332; F04C 2/348; F04C 2/352; F04C 18/352; F04C 28/22; F04C 29/12; F04C 2240/54

USPC ..... 418/16, 172, 173, 176, 177, 241

See application file for complete search history.

(56) References Cited

U.S. PATENT DOCUMENTS

| | | | | |
|---|---|---|---|---|
| 2,918,877 | A | 12/1959 | Woodcock | |
| 2006/0099100 | A1* | 5/2006 | Clements | F04C 2/3442 418/173 |
| 2010/0266434 | A1 | 10/2010 | Beez et al. | |

FOREIGN PATENT DOCUMENTS

| | | | |
|---|---|---|---|
| JP | 60-228791 | A | 11/1985 |
| JP | 2010-164056 | A | 7/2010 |
| WO | WO 2004/009992 | A1 | 1/2004 |

OTHER PUBLICATIONS

Extended European Search Report, dated May 9, 2016, 8 pages.

* cited by examiner

*Primary Examiner* — Jason Shanske
*Assistant Examiner* — Kelsey Stanek
(74) *Attorney, Agent, or Firm* — Foley & Lardner LLP

(57) ABSTRACT

A variable displacement pump includes a housing having a pair of end wall surfaces; an annular outer rotor guide swingably disposed between the pair of end wall surfaces; a cylindrical outer rotor; an inner rotor provided radially inward of the outer rotor and configured to rotate integrally with a drive shaft at a location eccentric relative to the outer rotor; and a plurality of coupling plates coupling the inner rotor and the outer rotor. The outer rotor is rotatably fitted into an outer rotor supporting surface of the outer rotor guide. A space between the inner rotor and the outer rotor is partitioned into a plurality of chambers by the plurality of coupling plates. A concave portion is formed in the outer rotor supporting surface such that the concave portion exists over an entire axial range between the both end surfaces of the outer rotor guide.

5 Claims, 8 Drawing Sheets

(51) Int. Cl.
*F04C 28/22* (2006.01)
*F04C 29/12* (2006.01)

VARIABLE DISPLACEMENT PUMP

BACKGROUND OF THE INVENTION

The present invention relates to a variable displacement pump that is used, for example, for supplying lubricating oil to an internal combustion engine or an automatic transmission.

As an oil pump that is used for an internal combustion engine or an automatic transmission, etc., Japanese Patent Application Publication No. 2010-164056 discloses a previously-proposed variable displacement pump including a swing-type outer rotor guide. In this technique, the outer rotor guide is swingably held inside a pump housing. Moreover, a cylindrical outer rotor is rotatably fitted into the outer rotor guide. Accordingly, the outer rotor rotates relative to the outer rotor guide, in response to rotation of an inner rotor coupled through a plurality of coupling plates with the outer rotor.

SUMMARY OF THE INVENTION

In the case of the pump as constructed above, a contact area between an inner circumferential surface of the outer rotor guide and an outer circumferential surface of the outer rotor is large. Because the outer rotor rotates while shearing oil film formed between the inner circumferential surface of the outer rotor guide and the outer circumferential surface of the outer rotor, a shearing resistance is high. Therefore, there is a problem that a torque necessary to drive the pump is large. In particular, this problem becomes prominent at the time of low temperature under which oil viscosity is high.

It is an object of the present invention to provide a variable displacement pump devised to solve or ease the above problem.

According to one aspect of the present invention, there is provided a variable displacement pump comprising: a housing including a pair of end wall surfaces through which a drive shaft passes, wherein a suction port and a discharge port are formed in at least one of the pair of end wall surfaces; an annular outer rotor guide swingably disposed between the pair of end wall surfaces such that both end surfaces of the outer rotor guide are in close contact with the pair of end wall surfaces, wherein the outer rotor guide includes an outer rotor supporting surface given in a cylinder-surface shape, the drive shaft passing radially inward of the outer rotor supporting surface; a cylindrical outer rotor including an outer circumferential surface given in a cylinder-surface shape, the outer rotor being rotatably fitted into the outer rotor supporting surface; an inner rotor provided radially inward of the outer rotor and configured to rotate integrally with the drive shaft at a location eccentric relative to the outer rotor; and a plurality of coupling plates coupling the inner rotor and the outer rotor such that rotational force is transmitted from the inner rotor to the outer rotor, wherein a space between the inner rotor and the outer rotor is partitioned into a plurality of chambers by the plurality of coupling plates, and a concave portion is formed in the outer rotor supporting surface such that the concave portion exists over an entire axial range between the both end surfaces of the outer rotor guide.

DETAILED DESCRIPTION OF THE INVENTION

Reference will hereinafter be made to the drawings in order to facilitate a better understanding of the present invention.

An embodiment according to the present invention will be explained in detail referring to FIGS. 1 to 8.

Figure 1:
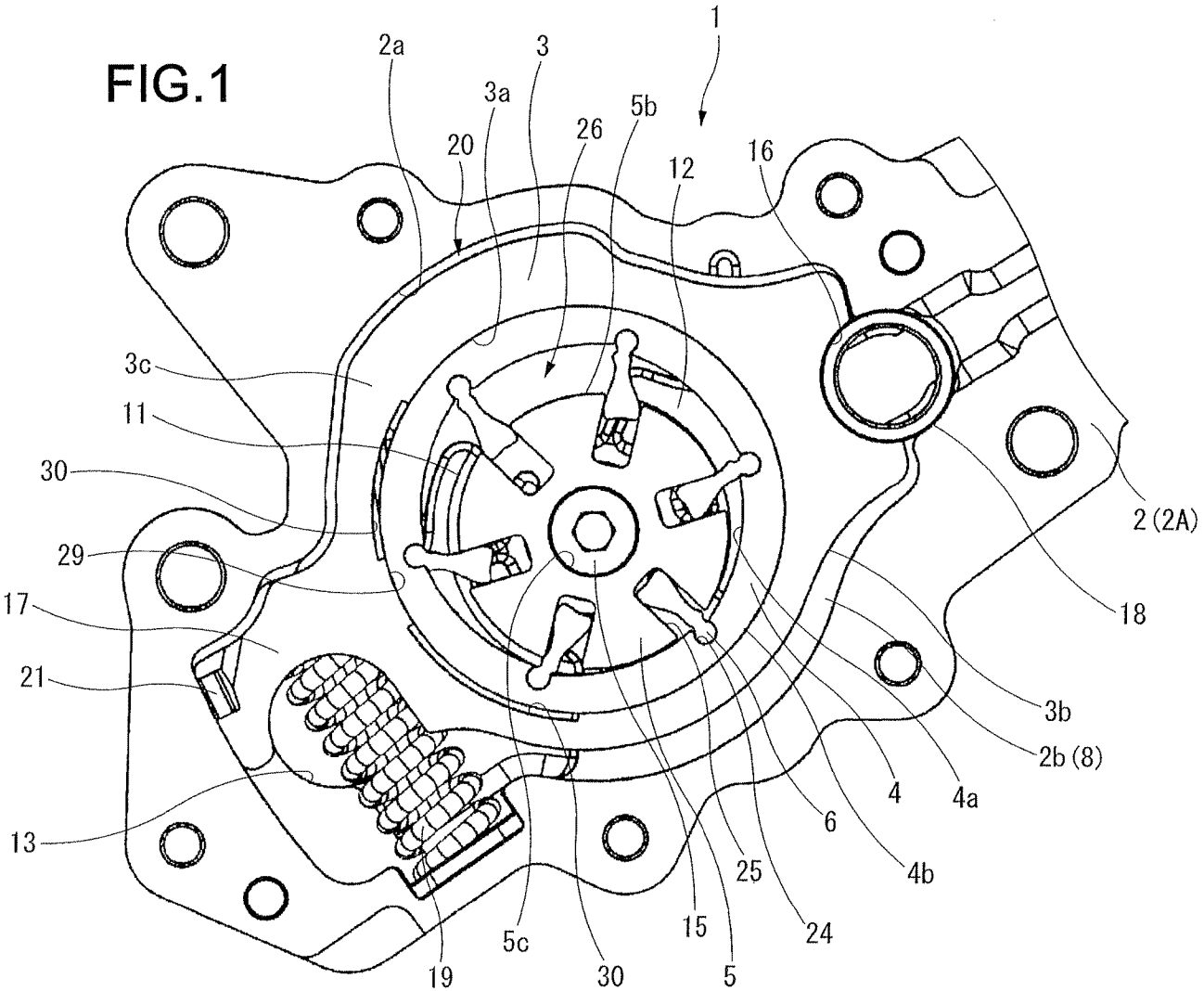
FIG. 1 is a front view of a variable displacement pump according to the present invention.
Figure 2:
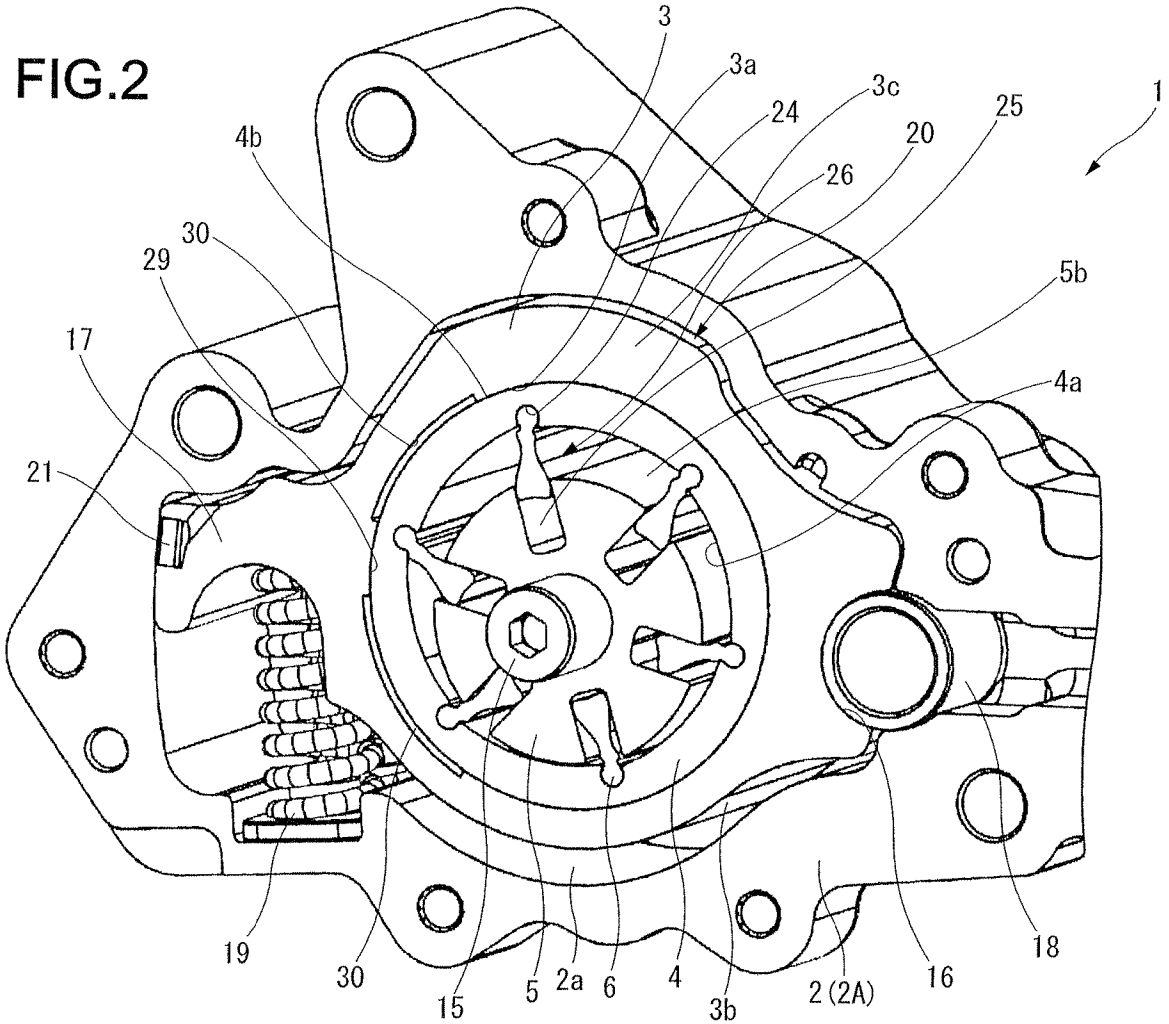
FIG. 2 is an oblique perspective view of the variable displacement pump according to the present invention.

FIG. 1 is a view showing a state where an end plate (not shown) has been detached from a variable displacement pump according to the present invention. FIG. 2 is an oblique perspective view of the state shown by FIG. 1. The variable displacement pump 1 includes a housing 2, an outer rotor guide 3, an outer rotor 4, an inner rotor 5, and a plurality of pendulum-type coupling plates 6. The outer rotor guide 3 is formed in an annular shape (circular-ring shape) and arranged inside the housing 2. The outer rotor 4 is formed in a cylindrical shape (circular tube shape) and fitted into the outer rotor guide 3. The inner rotor 5 is arranged radially inward of the outer rotor 4. The plurality of pendulum-type coupling plates 6 couple (connect) the outer rotor 4 with the inner rotor 5.

The housing 2 includes a body portion 2A and the end plate (not shown). The body portion 2A includes a peripheral wall surface 2*a* and an end wall surface 2*b* which is located at axially one end portion of the body portion 2A. The body portion 2A is formed with a concave portion 8 (see FIG. 5) defined by the peripheral wall surface 2*a* and the end wall surface 2*b*. The end plate covers the concave portion 8. The end plate is integrally fastened to the body portion 2A by bolts or the like. The end plate (not shown) includes an end wall surface (not shown) which is located at axially another end portion of the body portion 2A. The end wall surface (not shown) of the end plate faces the end wall surface 2*b* of the concave portion 8. In this embodiment, a suction port 11 and a discharge port 12 are formed in the end wall surface 2*b* of the body portion 2A. The suction port 11 communicates with (i.e., is open to) an inlet 13 whereas the discharge port 12 communicates with (i.e., is open to) an outlet (not shown) formed in the end plate. The suction port 11 and the discharge port 12 are separated from each other and located away from each other by an appropriate angle (e.g. center portions thereof are away from each other by 180 degrees). Moreover, a drive shaft 15 is provided to the housing 2 such that the drive shaft 15 passes through the end wall surface 2*b* of the body portion 2A and the end wall surface of the end plate.

The annular outer rotor guide 3 includes an outer rotor supporting surface 3*a*, an outer circumferential surface 3*b*, and a pair of end surfaces 3*c*. The outer rotor supporting surface 3*a* is formed as a surface of axially-penetrating cylindrical hollow of the annular outer rotor guide 3. The outer rotor guide 3 is disposed inside the housing 2 such that the pair of end surfaces 3*c* are respectively in intimate contact with the end wall surface 2*b* and the end wall surface of the end plate. The outer rotor guide 3 includes a bearing portion 16 at one side portion of the outer rotor guide 3 (with respect to a direction perpendicular to an axial direction of the pump), and an arm 17 at another side portion of the outer rotor guide 3 which is opposite to the one side portion of the outer rotor guide 3. The bearing portion 16 is formed by depressing the one side portion of the outer rotor guide 3 in a half-cylindrical concave shape (i.e. in a half-round concave shape in cross section). The arm 17 is formed to protrude from the another side portion of the outer rotor guide 3. The outer rotor guide 3 is swingably supported by the body portion 2A through a shaft 18 which is engaging with the bearing portion 16. A spring 19 is provided between the arm 17 and the body portion 2A. A pressure control chamber 20 is separately formed between the outer circumferential surface 3*b* and the peripheral wall surface 2*a* of the body portion 2A, on an opposite side of the outer rotor guide 3 from the spring 19. The pressure control chamber 20 extends along a longitudinal direction of the outer rotor guide 3. The spring 19 biases the outer rotor guide 3 in a direction that reduces a volume of the pressure control chamber 20. The pressure control chamber 20 is sealed from the inlet 13 by a seal piece 21. The seal piece 21 is provided near a tip portion of the arm 17.

Six plate-retaining grooves 24 are formed in an inner circumferential surface 4*a* of the cylindrical outer rotor 4 at even intervals. Each of the six plate-retaining grooves 24 is formed in a circular shape in cross section as viewed in the axial direction of the variable displacement pump 1. Alternatively, the six plate-retaining grooves 24 may be formed in the inner circumferential surface 4*a* at uneven intervals. Moreover, an outer circumferential surface 4*b* of the cylindrical outer rotor 4 is formed as a simple cylindrical surface. The outer circumferential surface 4*b* of the cylindrical outer rotor 4 is rotatably fitted into the outer rotor supporting surface 3*a*. Strictly speaking, it is noted that a very minute gap in which oil film is formed exists between the outer circumferential surface 4*b* and the outer rotor supporting surface 3*a*.

The inner rotor 5 which is rotatably provided radially inside the outer rotor 4 includes an outer circumferential surface 5*b* formed as a cylindrical surface. Moreover, the inner rotor 5 is formed with an attachment hole 5*c* which axially passes through a center of the inner rotor 5. The drive shaft 15 is fixed into the attachment hole 5*c*, i.e. fixed to the inner rotor 5. The drive shaft 15 is eccentric relative to the outer rotor 4. That is, an axis of the drive shaft 15 is deviated from a center (axis) of the outer rotor 4. Hence, the inner rotor 5 rotates integrally with the drive shaft 15, at a location eccentric relative to the outer rotor 4. Since the inner rotor 5 is eccentric relative to the outer rotor 4, a crescent-shaped space (as viewed in the axial direction) as a whole is formed between the inner rotor 5 and the outer rotor 4. This crescent-shaped space communicates with (is open to) the suction port 11 and the discharge port 12. Moreover, six slots 25 are formed in the outer circumferential surface 5*b* at even intervals such that each of the six slots 25 extends in a radial direction of the inner rotor 5.

Figure 3:
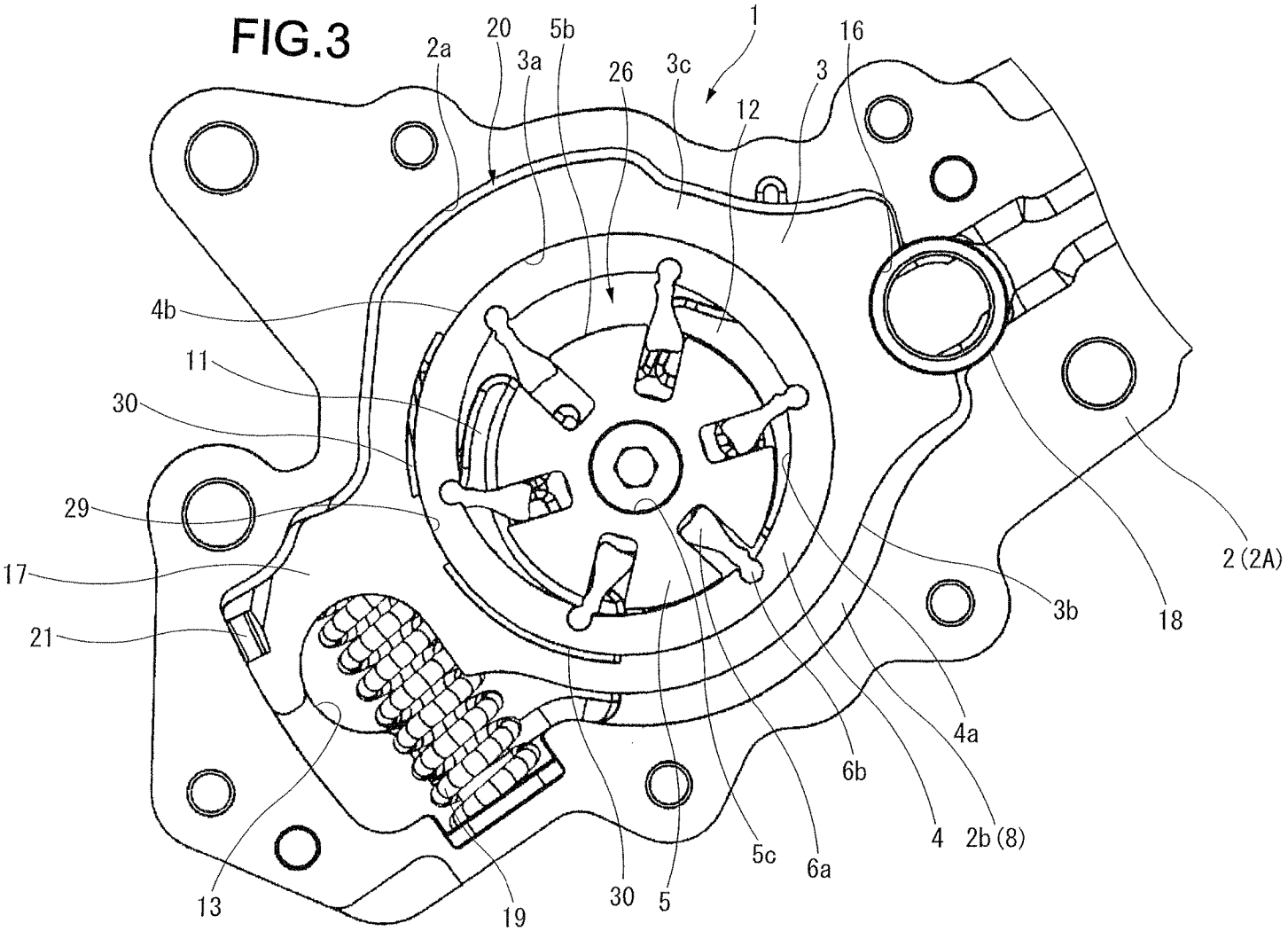
FIG. 3 is a front view of a main region of the variable displacement pump according to the present invention.
Figure 4:
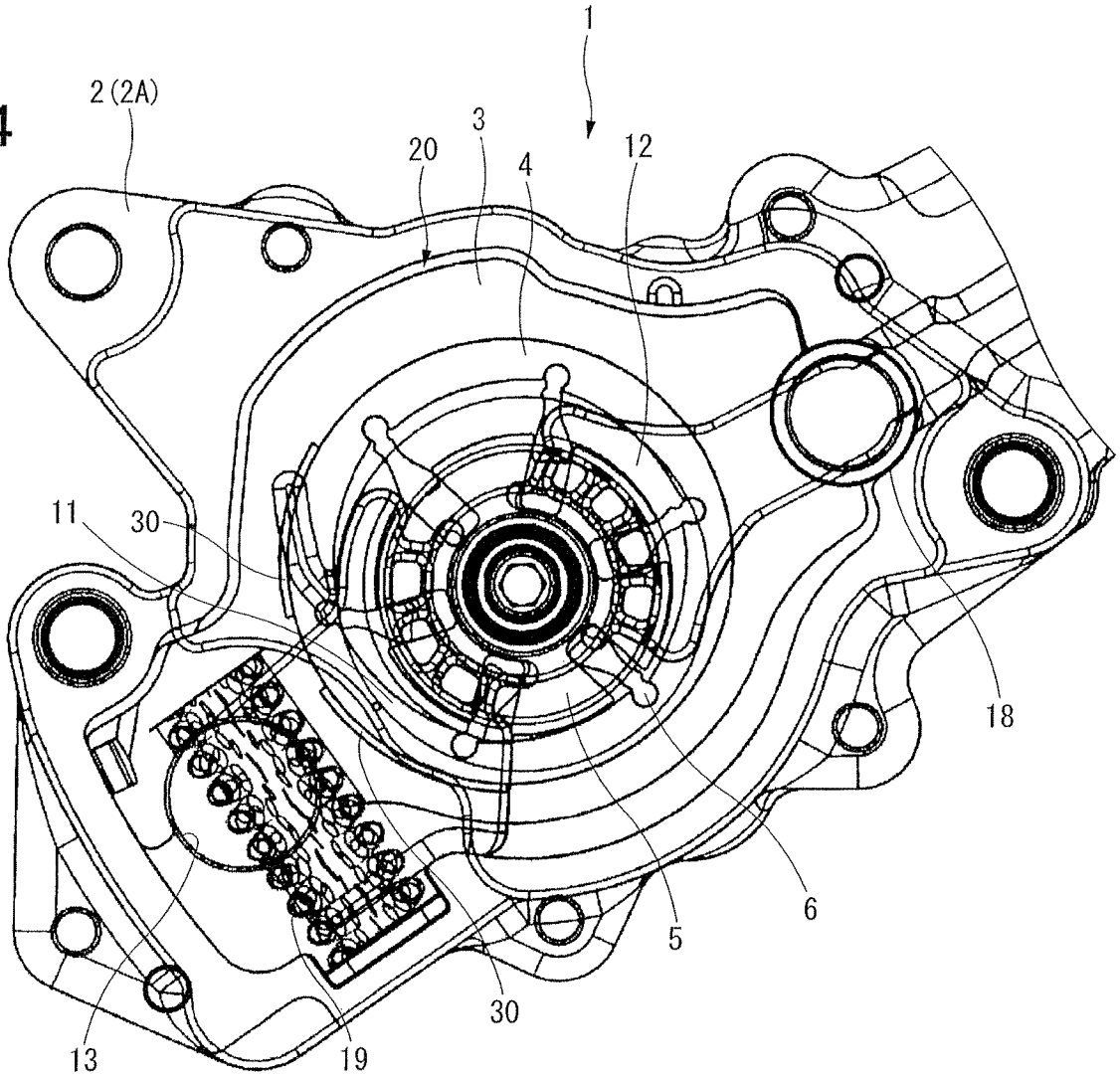
FIG. 4 is a perspective view of the variable displacement pump according to the present invention.

As shown in FIG. 3, each of the coupling plates 6 includes a radially inner end 6*a* and a radially outer end 6*b*. The radially inner end 6*a* is substantially in the form of triangle which expands along a radially inner direction in cross section (as viewed in the axial direction). The radially outer end 6*b* is in the form of circle in cross section (as viewed in the axial direction). The radially outer end 6*b* is swingably fitted into the plate-retaining groove 24 of the outer rotor 4 whereas the radially inner end 6*a* is inserted into the slot 25 of the inner rotor 5 and is slidable in the slot 25. Accordingly, rotational force of the inner rotor 5 is transmitted to the outer rotor 4. The above-mentioned crescent-shaped space between the inner rotor 5 and the outer rotor 4 is separately partitioned into six chambers 26 by the six coupling plates 6.

Each of the housing 2, the outer rotor guide 3, the outer rotor 4 and the inner rotor 5 is formed of a synthetic resin or a sintered metal.

In the variable displacement pump 1 constructed as above, when the inner rotor 5 rotates via the drive shaft 15 in a clockwise direction of FIG. 1, rotational force is transmitted through the coupling plates 6 to the outer rotor 4 so that the outer rotor 4 rotates in the same direction (the clockwise direction of FIG. 1). A distance between the inner circumferential surface 4*a* of the cylindrical outer rotor 4 and the outer circumferential surface 5*b* of the inner rotor 5 varies according to rotational positions (circumferential positions) of the outer rotor 4 and the inner rotor 5 which are eccentric relative to each other. Hence, a volume of each chamber 26 also varies according to the rotational positions of the outer rotor 4 and the inner rotor 5. The volume of each chamber 26 takes its minimum at a lower side of FIG. 1, and gradually increases with the clockwise rotation. Then, the volume of each chamber 26 takes its maximum at an upper side of FIG. 1, and then decreases with the clockwise rotation. By this volume variation of the chamber 26, a pump function of pumping oil from the suction port 11 to the discharge port 12 can be attained.

A hydraulic pressure (oil pressure) in a main gallery of the engine or a control hydraulic pressure adjusted by a control solenoid is supplied to the pressure control chamber 20. When hydraulic pressure of the pressure control chamber 20 is low, an eccentricity amount of the inner rotor 5 (relative to the outer rotor guide 3 and the outer rotor 4) is enlarged by the outer rotor guide 3 biased by the spring 19 in the direction that reduces the pressure control chamber 20, as shown in FIGS. 1 and 3. As a result, a pump capacity becomes high. On the other hand, when the hydraulic pressure of the pressure control chamber 20 is high, the outer rotor guide 3 swings against biasing force of the spring 19 in a direction that enlarges the pressure control chamber 20 so that the eccentricity amount of the inner rotor 5 is reduced. As a result, the pump capacity becomes low.

Next, the outer rotor guide 3 will now be explained in detail referring to FIGS. 5 to 8.

Figure 5:
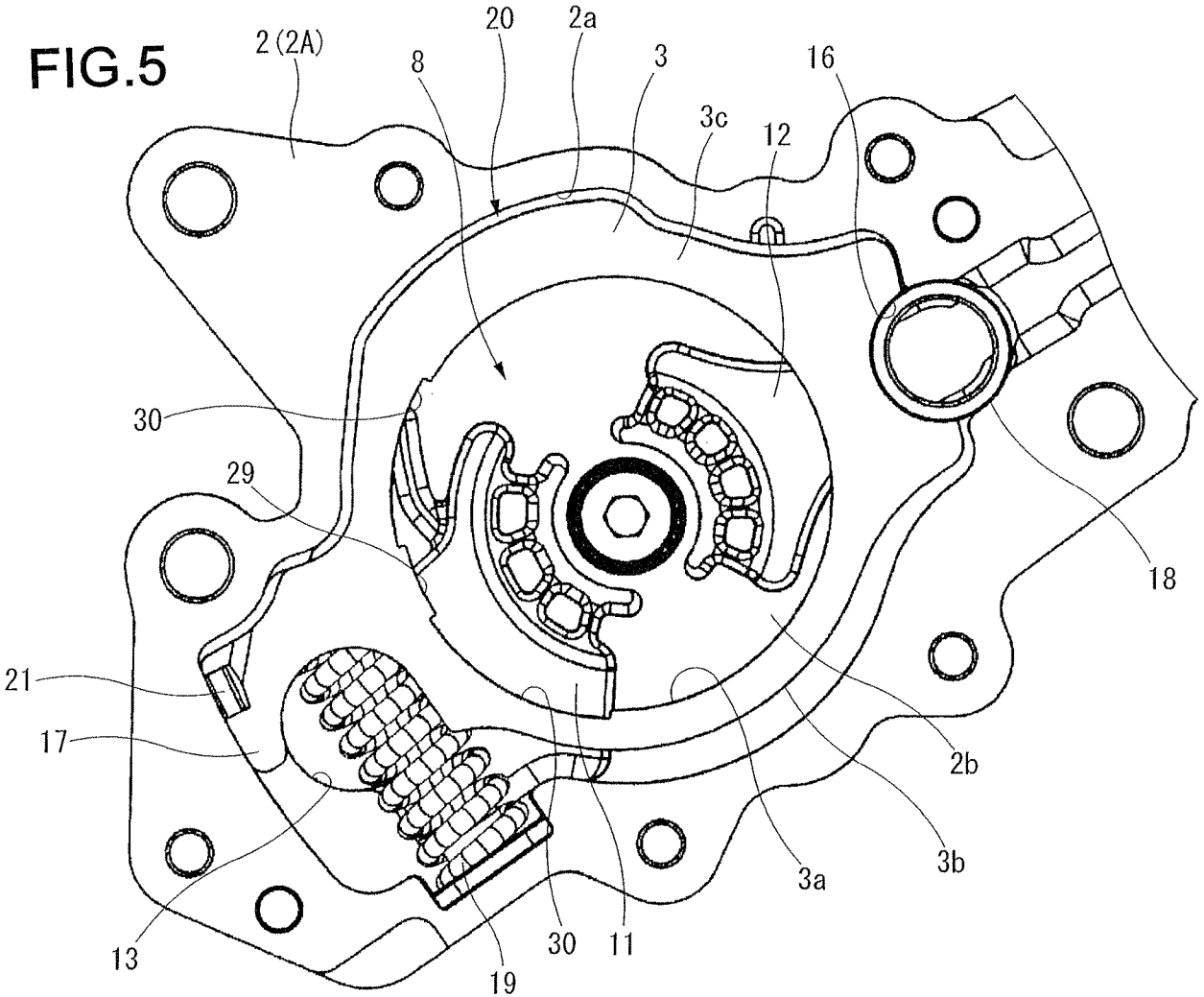
FIG. 5 is a front view of a housing and an outer rotor guide of the variable displacement pump.
Figure 6:
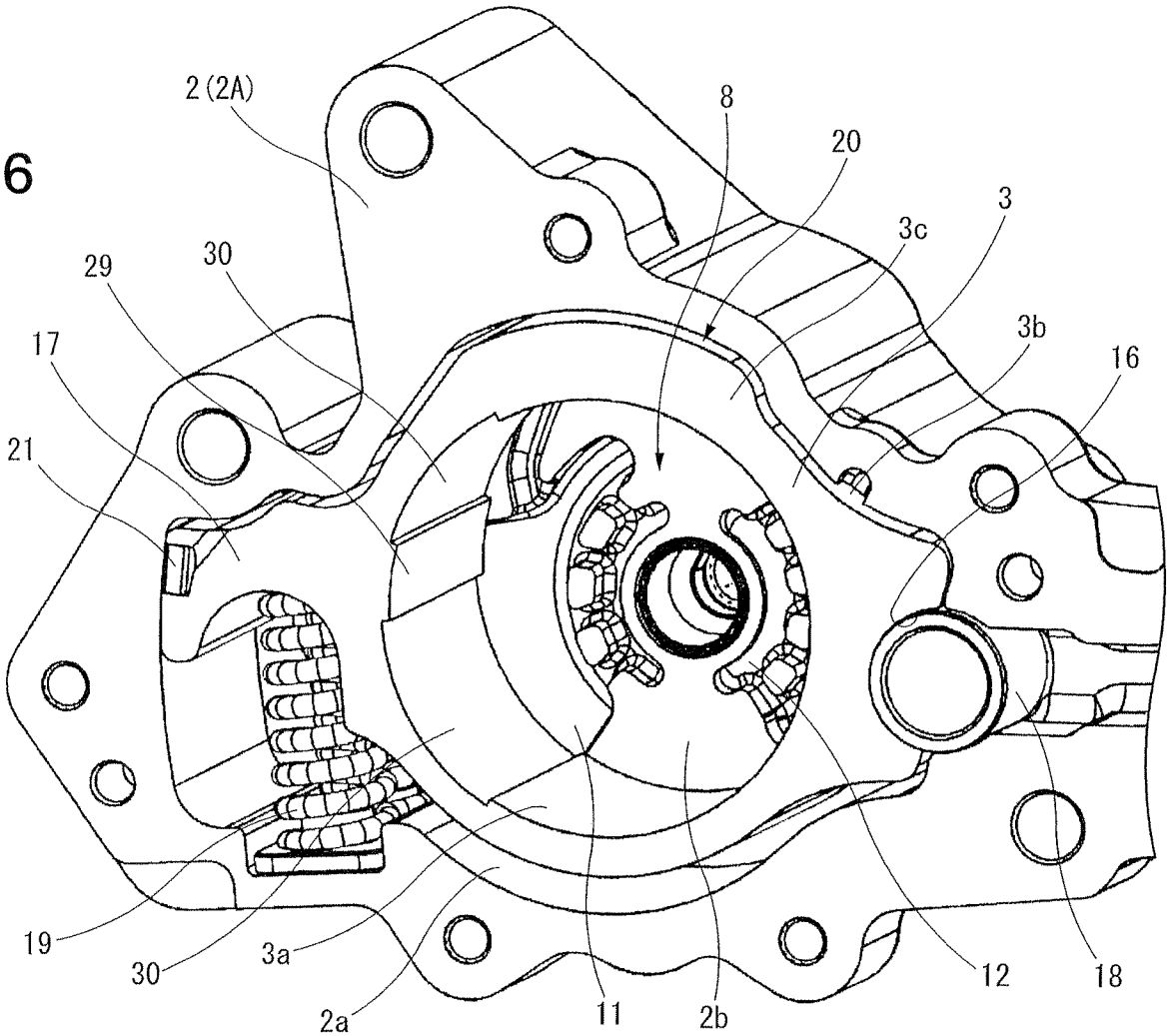
FIG. 6 is an oblique perspective view of the housing and the outer rotor guide.
Figure 7:
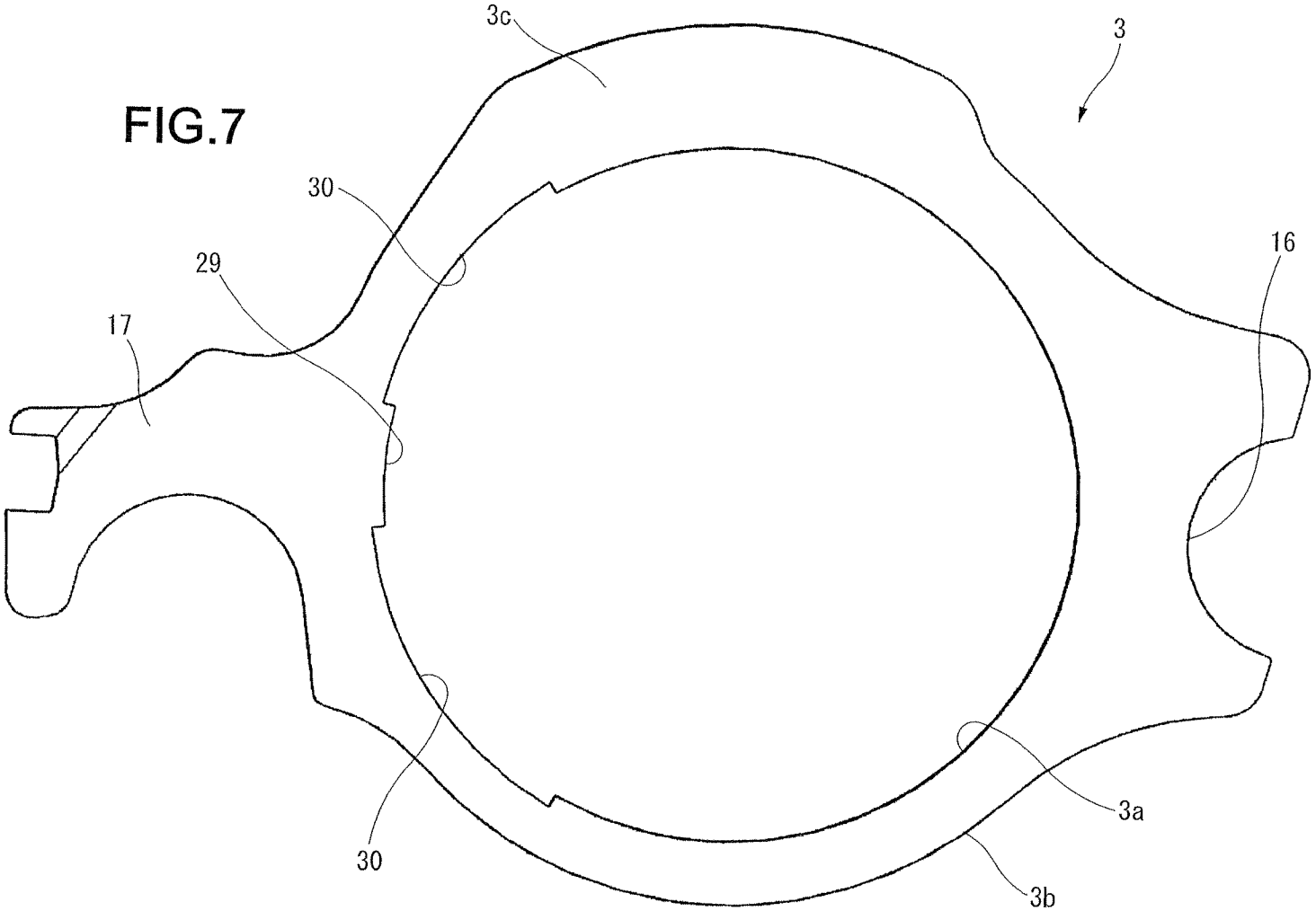
FIG. 7 is a front view of the outer rotor guide.
Figure 8:
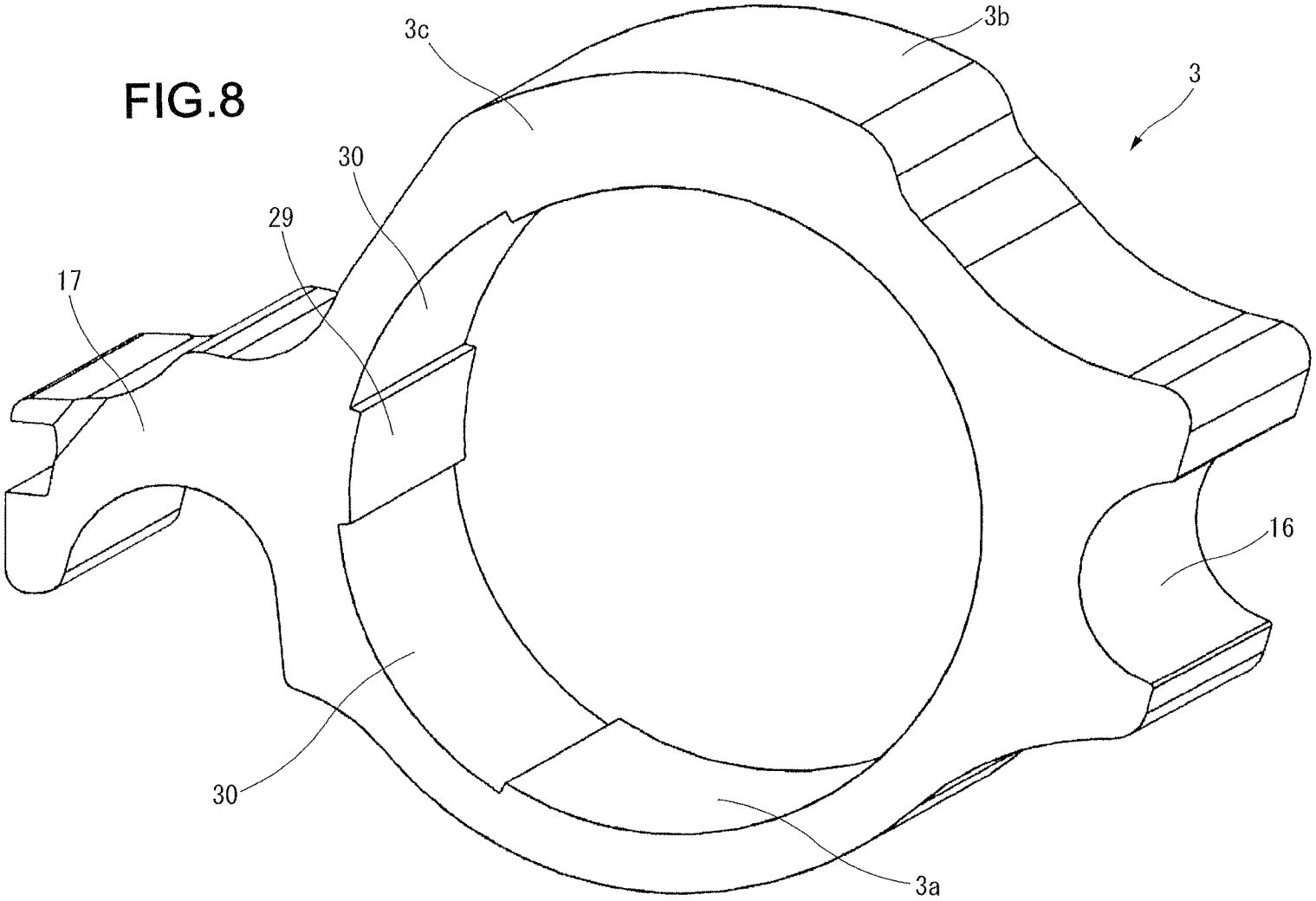
FIG. 8 is an oblique perspective view of the outer rotor guide.

As shown in FIGS. 7 and 8, the outer rotor supporting surface 3*a* of the outer rotor guide 3 is formed with two concave portions 30 each of which is continuous over an axially entire range between the pair of end surfaces 3*c*. That is, each of the two concave portions 30 is formed in the outer rotor supporting surface 3*a* so as to penetrate the outer rotor guide 3 in the axial direction. A pad portion 29 is provided circumferentially between the two concave portions 30. That is, the pad portion 29 is a part of the cylinder-surface-shaped outer rotor supporting surface 3*a* which remains between the two concave portions 30 after forming the two concave portions 30. The pad portion 29 exists substantially at a location corresponding to a center of the suction port 11 which extends in an arc shape, as viewed in the axial direction. In other words, the pad portion 29 radially overlaps with a substantially center portion of the arc-shaped suction port 11. The pad portion 29 functions to suppress a backlash of the outer rotor 4 disposed in the outer rotor guide 3. As shown in FIGS. 5 and 6, the two concave portions 30 extend in a circumferential direction of the outer rotor guide 3 such that whole of the two concave portions 30 is within a region of the suction port 11, i.e. within an angular range (circumferential range) of the arc-shaped suction port 11. In other words, the two concave portions 30 completely overlap with a part of the circumferential range of the arc-shaped suction port 11, with respect to the radial direction. Moreover, it is favorable that each of the concave portions 30 is located within the region of the suction port 11 even when the outer rotor guide 3 swings during a pump operation. According to the present invention, a depth of each concave portion 30 in the radial direction is not limited to any value, but is set such that a shearing force of oil film is sufficiently reduced.

Hydraulic pressure of each of the six chambers 26 becomes higher as the chamber 26 becomes closer to the discharge port 12 during the pump operation. That is, one of the six chambers 26 which is close to the discharge port 12 has a higher pressure than another of the six chambers 26 which is away from the discharge port 12. Hence, the outer rotor 4 is pushed toward the discharge port 12, inside of the outer rotor guide 3. As a result, a high surface pressure is applied to a part of the outer rotor supporting surface 3*a* which is near the discharge port 12 and which is tightly in contact with the cylindrical outer rotor 4 whereas a low surface pressure is applied to a part of the outer rotor supporting surface 3*a* which is near the suction port 11. Hence, a concern about local abrasion is not brought even if the concave portions 30 are formed in the outer rotor supporting surface 3*a* at the location corresponding to the circumferential region of the suction port 11. Therefore, it is favorable that the concave portions 30 are formed in the outer rotor supporting surface 3*a* near the suction port 11. In a case that the concave portions 30 are formed in the outer rotor supporting surface 3*a* at a location (radially) corresponding to a circumferential region of the discharge port 12, a very high surface pressure is applied to the part of the outer rotor supporting surface 3*a* which is near the discharge port 12. In consideration of this, any concave portion 30 is not formed in the part of the outer rotor supporting surface 3*a* which (radially) corresponds to the region of the discharge port 12, in this embodiment.

Moreover, any concave portion 30 is not formed also in a part of the outer rotor supporting surface 3*a* which (radially) corresponds to a circumferential region between the suction port 11 and the discharge port 12. This is because there is a risk that high-pressure oil becomes easy to leak through the concave portion 30 to a low-pressure side so as to cause a reduction of pump performance, in the case that the concave portion 30 is formed in the part of the outer rotor supporting surface 3*a* which corresponds to the region between the suction port 11 and the discharge port 12.

According to the above-mentioned structures in this embodiment, a contact area between the outer rotor supporting surface 3*a* of the outer rotor guide 3 and the outer circumferential surface 4*b* of the outer rotor 4 is reduced by virtue of the concave portions 30, without being associated with an excessive rise of surface pressure.

That is, because the two concave portions 30 each of which is formed continuously from one end surface 3*c* to another end surface 3*c* are provided in this embodiment, the contact area between the outer rotor supporting surface 3*a* of the outer rotor guide 3 and the outer circumferential surface 4*b* of the outer rotor 4 is reduced by that amount. Accordingly, a shearing resistance between the outer rotor supporting surface 3*a* and the outer circumferential surface 4*b* can be reduced. As a result, the torque necessary to drive the pump can be reduced.

Moreover, according to the embodiment, each of the concave portions 30 is continuously formed over the axially entire range between the both end surfaces 3*c* of the outer rotor guide 3, as mentioned above. Hence, the outer rotor guide 3 including the concave portions 30 can be easily molded by use of a die at a low cost, when molding the outer rotor guide 3 by a sintering or a synthetic-resin molding. Alternatively, the concave portions 30 can be easily shaped by machine processing because axially both ends of the outer rotor guide 3 are open.

Moreover, in this embodiment, the high-pressure oil can be inhibited from leaking through the concave portions 30 to the low-pressure suction side as compared with a case that one circumferentially-continuous concave portion is formed.

Although the invention has been described above with reference to certain embodiments of the invention, the invention is not limited to the embodiments described above. Modifications and variations of the embodiments described above will occur to those skilled in the art in light of the above teachings.

For example, in the above embodiment, the two concave portions 30 are formed in the outer rotor supporting surface 3*a*. However, the structure according to the present invention is not limited to this. According to the present invention, one concave portion 30 may be provided. Alternatively, three or more concave portions 30 may be provided.

For example, in this embodiment, the suction port 11 and the discharge port 12 are formed in the end wall surface 2*b* of the housing body portion 2A. However, the structure according to the present invention is not limited to this. According to the present invention, each of the suction port 11 and the discharge port 12 may be formed in both of the end wall surface 2*b* and the end wall surface of the end plate. Alternatively, the suction port 11 and the discharge port 12 may be formed only in the end wall surface of the end plate. Further alternatively, one of the suction port 11 and the discharge port 12 may be formed in the end wall surface 2*b* while forming another of the suction port 11 and the discharge port 12 in the end wall surface of the end plate.

For example, in this embodiment, the six plate-retaining grooves 24 are provided in the inner circumferential surface 4*a* of the cylindrical outer rotor 4 at even circumferential intervals. However, according to the present invention, the number of plate-retaining grooves 24 is not limited to six. Moreover, according to the present invention, the plate-retaining grooves 24 may be provided in the inner circumferential surface 4*a* at uneven circumferential intervals.

This application is based on a prior Japanese Patent Application No. 2014-261445 filed on Dec. 25, 2014. The entire contents of this Application are hereby to incorporated by reference.

The scope of the invention is defined with reference to the following claims.

What is claimed is:

1. A variable displacement pump comprising:

a housing including a pair of end wall surfaces through which a drive shaft passes, wherein a suction port and a discharge port are formed in at least one of the pair of end wall surfaces;

an annular outer rotor guide having two end surfaces, the annular outer rotor guide swingably disposed between the pair of end wall surfaces such that both of the end surfaces of the outer rotor guide are in close contact with the pair of end wall surfaces, wherein the outer rotor guide includes an outer rotor supporting surface having a cylinder-surface shape, the drive shaft passing radially inward of the outer rotor supporting surface;

a cylindrical outer rotor including an outer circumferential surface having a cylinder-surface shape, the outer rotor being rotatably fitted into the outer rotor supporting surface;

an inner rotor provided radially inward of the outer rotor and configured to rotate integrally with the drive shaft at a location eccentric relative to the outer rotor; and a plurality of coupling plates coupling the inner rotor and the outer rotor such that rotational force is transmitted from the inner rotor to the outer rotor, wherein a space between the inner rotor and the outer rotor is partitioned into a plurality of chambers by the plurality of coupling plates, wherein a concave portion is formed in the outer rotor supporting surface such that the concave portion exists over an entire axial range between both of the end surfaces of the outer rotor guide, and wherein no concave portion is located within a circumferential region of the discharge port.

2. The variable displacement pump as claimed in claim 1, wherein the concave portion is located within a circumferential region of the suction port.

3. The variable displacement pump as claimed in claim 2, wherein the concave portion is located elsewhere than a circumferential region sandwiched between the suction port and the discharge port.

4. The variable displacement pump as claimed in claim 1, Further comprising another concave portion formed in the outer rotor supporting surface and formed continuously over the entire axial range between both of the end surfaces.

5. The variable displacement pump as claimed in claim 4, wherein the concave portions overlap with at least part of a circumferential range of the suction port.

* * * * *